US007891990B1

(12) United States Patent
Gao et al.

(10) Patent No.: US 7,891,990 B1
(45) Date of Patent: Feb. 22, 2011

(54) ELECTRICAL CONNECTOR

(75) Inventors: Ni Gao, Guang-Dong (CN); Wei-Hong Liao, Guang-Dong (CN); Ming Chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/588,985

(22) Filed: Nov. 4, 2009

(51) Int. Cl.
*H01R 12/00* (2006.01)

(52) U.S. Cl. ..... 439/79

(58) Field of Classification Search ..... 439/79, 439/559, 571, 572, 573, 569, 587, 701
See application file for complete search history.

(56) References Cited

U.S. PATENT DOCUMENTS

| | | | | | |
|---|---|---|---|---|---|
| 4,556,190 | A | * | 12/1985 | Smith | 249/99 |
| 4,907,987 | A | * | 3/1990 | Douty et al. | 439/571 |
| 5,074,807 | A | * | 12/1991 | Parmer | 439/553 |
| 5,080,611 | A | * | 1/1992 | Hypes | 439/567 |
| 5,228,870 | A | * | 7/1993 | Gorenc et al. | 439/567 |
| 5,478,257 | A | * | 12/1995 | Cachina et al. | 439/567 |
| 5,664,965 | A | * | 9/1997 | Clark et al. | 439/567 |
| RE35,735 | E | * | 2/1998 | Douty et al. | 439/571 |
| 5,795,187 | A | * | 8/1998 | Sipe | 439/567 |
| 5,827,089 | A | * | 10/1998 | Beck, Jr. | 439/567 |
| 5,899,771 | A | * | 5/1999 | Clark et al. | 439/567 |
| 5,989,064 | A | * | 11/1999 | Harlan et al. | 439/567 |
| 6,053,763 | A | * | 4/2000 | Brennan et al. | 439/491 |
| 6,086,417 | A | * | 7/2000 | Hsiao et al. | 439/567 |
| 6,093,057 | A | * | 7/2000 | Lok | 439/607.4 |
| 6,102,735 | A | * | 8/2000 | Chen et al. | 439/573 |
| 6,186,833 | B1 | * | 2/2001 | Wu | 439/668 |
| 6,511,329 | B2 | * | 1/2003 | Yi-Tsung | 439/76.1 |
| D589,886 | S | * | 4/2009 | Gao et al. | D13/147 |
| D605,597 | S | * | 12/2009 | Gao et al. | D13/147 |
| 7,677,904 | B1 | * | 3/2010 | Gao et al. | 439/79 |
| 2004/0060722 | A1 | * | 4/2004 | Chandrasekhar et al. | 174/52.1 |

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

An electrical connector adapted to be mounted in an electronic product includes an insulating housing, a plurality of terminals disposed in the insulating housing, a cover and an elastic band. The insulating housing has a front wall extending transversely and a sidewall extending rearward from a portion of the front wall. The sidewall defines a perforation longitudinally penetrating therethrough and further penetrating through the front wall. The cover is welded with a rear end of the sidewall to seal a rear end mouth of the perforation to stop water flowing into the electronic product along the perforation. The elastic band is transversely sleeved around a peripheral outer surface of the front wall to abut against corresponding insides of the electronic product for stopping water from flowing into the electronic product through chinks between the peripheral outer surface of the front wall and the corresponding insides of the electronic product.

7 Claims, 3 Drawing Sheets

ELECTRICAL CONNECTOR

BACKGROUND OF THE INVENTION

1. Field of the Invention

The present invention generally relates to an electrical connector, and more particularly to an electrical connector having a water-proof function.

2. The Related Art

A conventional electrical connector adapted to be mounted in an electronic product includes an insulating housing, a plurality of terminals disposed in the insulating housing and two covers. The insulating housing defines two perforations each penetrating therethrough for locking a corresponding latch of a mating connector therein. The cover is mounted on a rear portion of the insulating housing by means of a locking portion being buckled with a fixing section so as to cover a rear end mouth of the respective perforation for preventing dust outside the perforation from entering the electronic product along the perforation. However, a chink is generally formed between the locking portion and the fixing section that results in a slack engagement between the cover and the insulating housing. As a result, the water entering the perforation from an opened front end mouth of the perforation is apt to further flow into the electronic product through the chink between the cover and the insulating housing to damage the electronic product. Therefore, an electrical connector capable of overcoming the foregoing problem is required.

SUMMARY OF THE INVENTION

An object of the present invention is to provide an electrical connector adapted to be mounted in an electronic product. The electrical connector includes an insulating housing, a plurality of terminals disposed in the insulating housing, a cover and an elastic band. The insulating housing has a front wall extending transversely and a sidewall extending rearward from a portion of the front wall. The sidewall defines a perforation longitudinally penetrating therethrough and further penetrating through the front wall. The cover is welded with a rear end of the sidewall of the insulating housing to seal a rear end mouth of the perforation to stop water flowing into the electronic product along the perforation. The elastic band is transversely sleeved around a peripheral outer surface of the front wall of the insulating housing to abut against corresponding insides of the electronic product for stopping water from flowing into the electronic product through chinks between the peripheral outer surface of the front wall and the corresponding insides of the electronic product.

As described above, the electrical connector of the present invention can effectively stop water flowing into the electronic product along the perforation and the chinks between the peripheral outer surface of the front wall and the corresponding insides of the electronic product by means of the cover being tightly welded with the rear end of the sidewall and the elastic band being sleeved around the peripheral outer surface of the front wall to fully abut against the corresponding insides of the electronic product.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
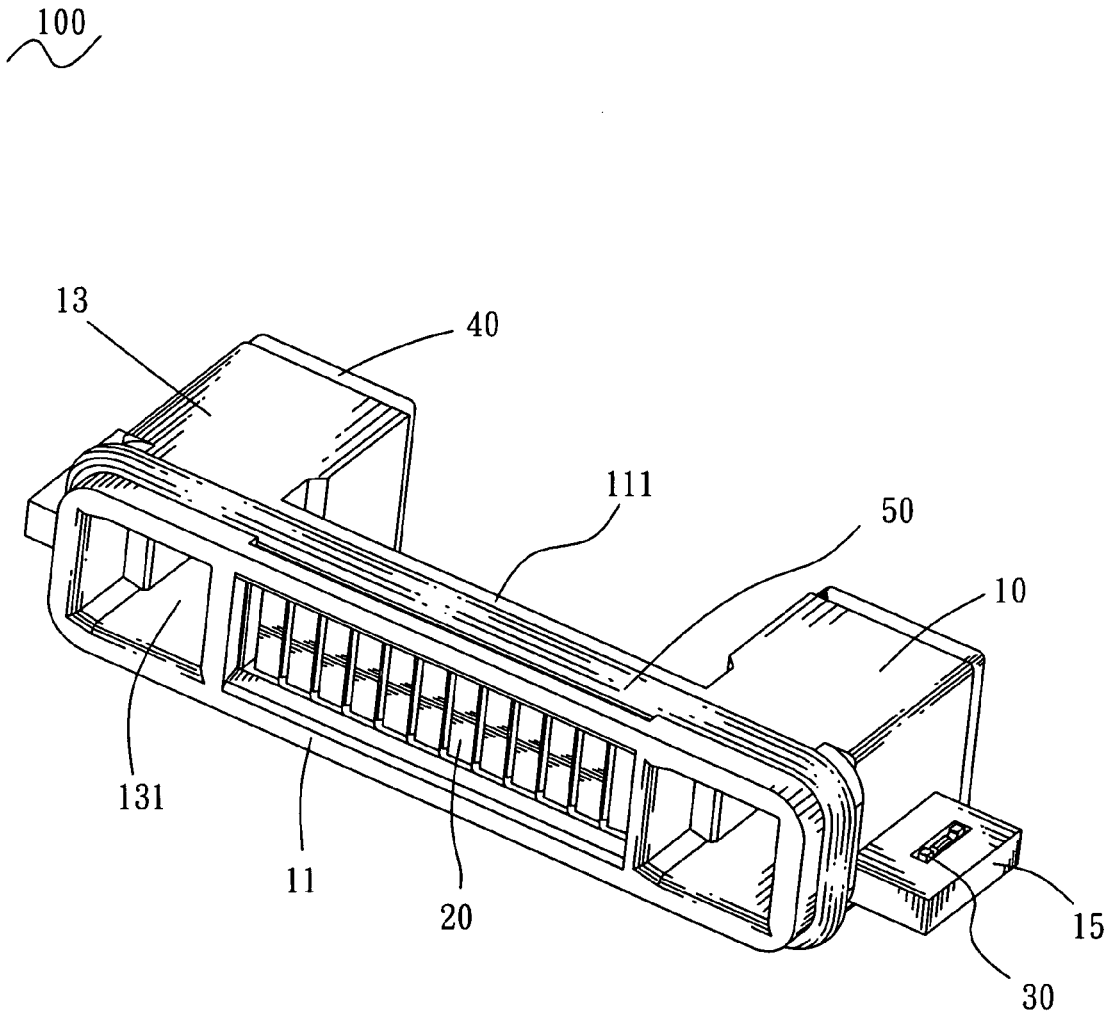
FIG. 1 is a perspective view of an electrical connector according to the present invention.
Figure 2:
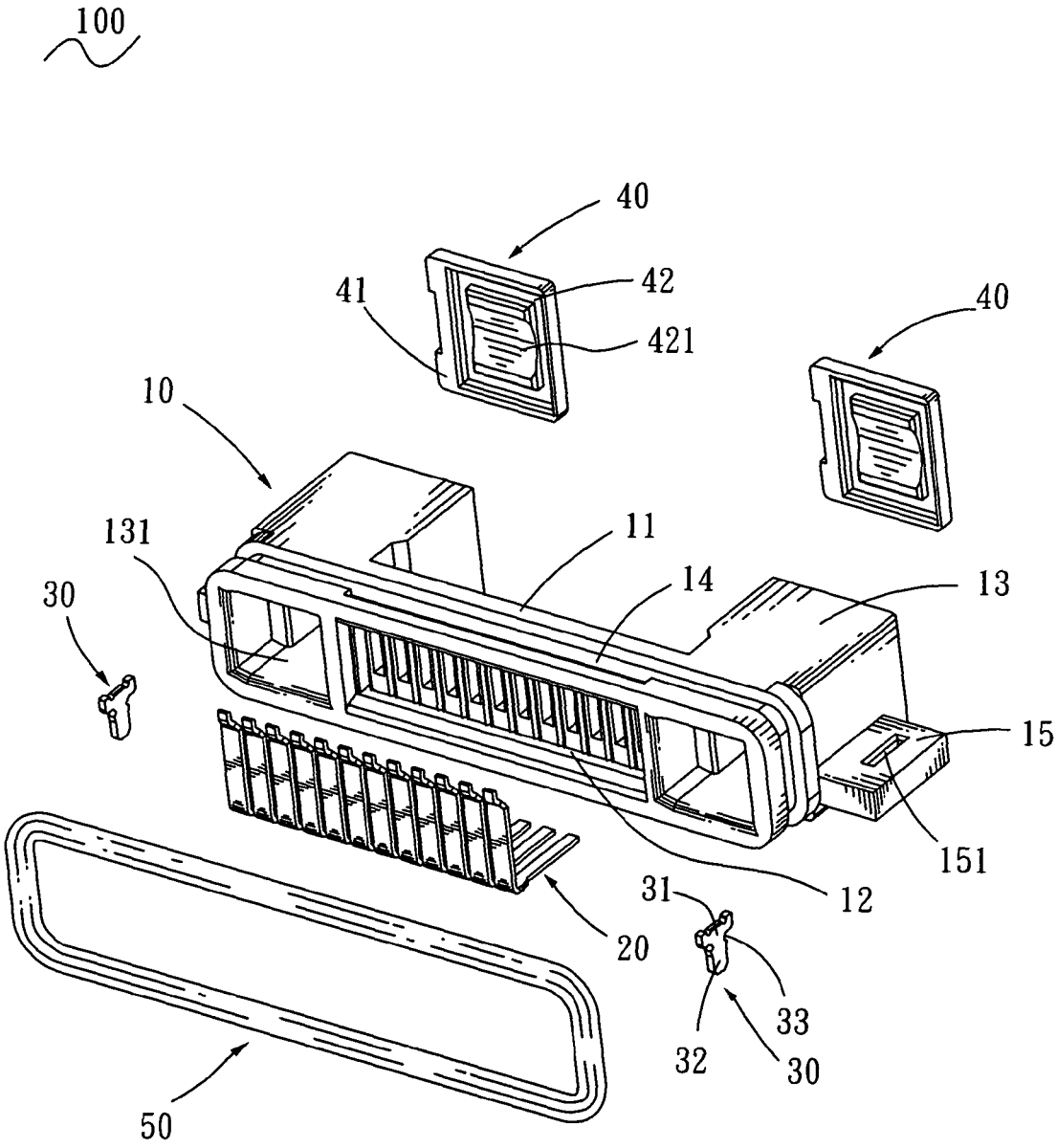
FIG. 2 is an exploded perspective view of the electrical connector of FIG. 1.

With reference to FIGS. 1-2, an electrical connector 100 according to the present invention includes an insulating housing 10, a plurality of terminals 20, two fastening members 30, two covers 40 and an elastic band 50 mounted to the insulating housing 10 respectively.

Figure 3:
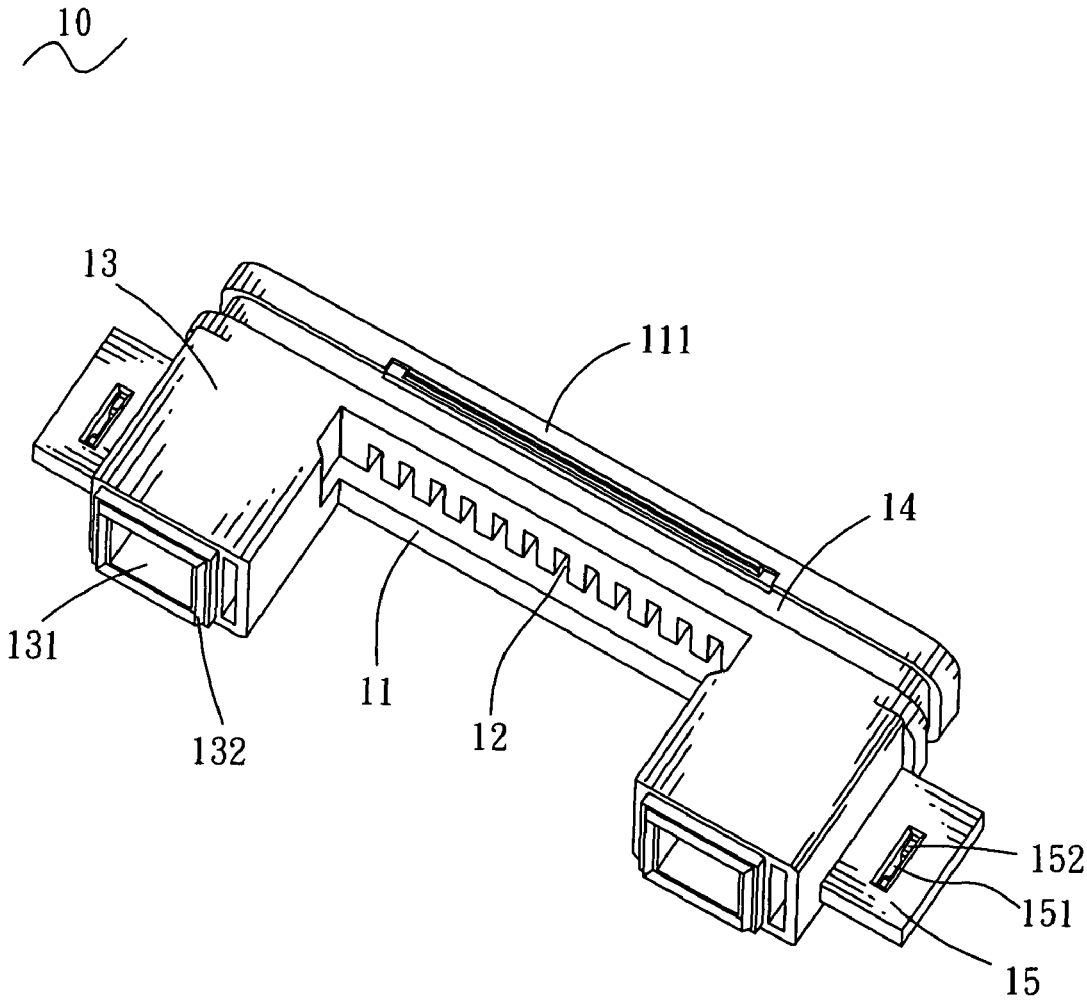
FIG. 3 is a perspective view of an insulating housing of the electrical connector of FIG. 1.

Referring to FIG. 2 and FIG. 3, the insulating housing 10 has a substantially rectangular front wall 11 extending transversely and a pair of sidewalls 13 extending rearward from two opposite ends of the front wall 11 and spaced from each other. A middle of the front wall 11 defines a plurality of cavities 12 arranged at regular intervals along a transverse direction thereof for receiving the corresponding terminals 20 respectively, wherein the terminals 20 are integrated in the corresponding cavities 12 of the insulating housing 10 by means of being injection molded in a single mold. A fastening groove 14 of rectangular-ring shape from a front view is provided around a peripheral outer surface 111 of the front wall 11. Each of the sidewalls 13 defines a rectangular perforation 131 longitudinally penetrating therethrough and further penetrating through the front wall 11. A rear end of each of the sidewalls 13 protrudes rearward to form a rectangular-ring shaped buckling portion 132 around a rear end mouth of the respective perforation 131. Two opposite outsides of the two sidewalls 13 oppositely protrude to respectively form an ear board 15 extending longitudinally with an inserting slot 151 vertically penetrating through a middle thereof. Two opposite ends of the inserting slot 151 face-to-face protrude into the inserting slot 151 to form a pair of buckling blocks 152 spaced from each other and located at a lower portion of the inserting slot 151.

Referring to FIG. 2 again, each of the fastening members 30 is of substantially T-shape with a base strip 31 and an inserting strip 32 perpendicularly extending from a middle of the base strip 31. Two opposite turnings of the junction of the base strip 31 and the inserting strip 32 are back-to-bake concaved inward to form a pair of buckling gaps 33. Each of the covers 40 has a rectangular base body 41 with a buckling fillister 42 of rectangular-ring shape being concaved inward from a surface thereof. Accordingly, a rectangular projection 421 is formed among the buckling fillister 42.

Referring to FIGS. 1-3 again, in assembly, the fastening member 30 is inserted in the inserting slot 151 of the corresponding ear board 15 of the insulating housing 10 and the buckling blocks 152 are buckled into the corresponding buckling gaps 33 for securing the fastening member 30 to the ear board 15. A free end of the inserting strip 32 of the fastening member 30 further projects out of the inserting slot 151 for being inserted in a printed circuit board (not shown) of an electronic product (not shown) to strengthen an engagement between the electrical connector 100 and the printed circuit board. The cover 40 is mounted onto the rear end of the corresponding sidewall 13 of the insulating housing 10 with the buckling portion 132 being buckled into the buckling fillister 42 and worn around the projection 421. Then an ultrasonic welding technology is provided to tightly weld the buckling portion 132 with inner surfaces of the buckling fillister 42 for avoiding a chink therebetween. Therefore, the cover 40 can tightly seal the rear end mouth of the corresponding perforation 131 to stop water, which enters the perforation 131 from an opened front end mouth of the perforation 131, flowing into the electronic product. The elastic band 50 is of rectangular-ring shape and made of high-temperature-resistant and water-resistant elastic materials. The elastic band 50 is sleeved in the fastening groove 14 of the insulating housing 10 and further projects beyond the peripheral outer surface 111 of the front wall 11 to fully abut against corresponding insides of the electronic product for effectively stopping water from flowing into the electronic product through chinks between the peripheral outer surface 111 of the insulating housing 10 and the corresponding insides of the electronic product.

As described above, the electrical connector 100 of the present invention can effectively stop water flowing into the electronic product along the perforations 131 and the chinks between the peripheral outer surface 111 of the insulating housing 10 and the corresponding insides of the electronic product by means of the covers 40 being tightly ultrasonic-welded to the rear ends of the respective sidewalls 13 and the elastic band 50 being sleeved around the peripheral outer surface 111 of the insulating housing 10 to fully abut against the corresponding insides of the electronic product.

What is claimed is:

1. An electrical connector adapted to be mounted in an electronic product, comprising:

an insulating housing having a front wall extending transversely and a sidewall extending rearward from a portion of the front wall, the sidewall defining a perforation longitudinally penetrating therethrough and further penetrating through the front wall, the rear end of the sidewall protrudes rearward to form a buckling portion around the rear end mouth of the perforation;

a plurality of terminals disposed in the insulating housing;

a cover welded with a rear end of the sidewall of the insulating housing to seal a rear end mouth of the perforation to stop water flowing into the electronic product along the perforation, the cover defining a ring-shaped buckling fillister concaved inward from a surface thereof, a projection being formed among the buckling fillister, the buckling portion being welded in the buckling fillister and worn around the projection for avoiding a chink therebetween; and an elastic band which being transversely sleeved around a peripheral outer surface of the front wall of the insulating housing to abut against corresponding insides of the electronic product for stopping water from flowing into the electronic product through chinks between the peripheral outer surface of the front wall and the corresponding insides of the electronic product.

2. The electrical connector as claimed in claim 1, wherein the cover is welded with the rear end of the sidewall by means of an ultrasonic welding technology.

3. The electrical connector as claimed in claim 1, wherein a ring-shaped fastening groove is transversely opened around the peripheral outer surface of the front wall, the elastic band is sleeved in the fastening groove and further projects beyond the peripheral outer surface of the front wall.

4. The electrical connector as claimed in claim 1, wherein the elastic band is made of high-temperature-resistant and water-resistant elastic materials.

5. The electrical connector as claimed in claim 1, wherein a portion of an outside of the sidewall protrudes outward to form an ear board extending longitudinally with an inserting slot vertically penetrating therethrough, the electrical connector further includes a fastening member inserted in the inserting slot and projecting beyond the ear board for mounting to the electronic product.

6. The electrical connector as claimed in claim 5, wherein the fastening member has a base strip and an inserting strip perpendicularly extending from a substantial middle of the base strip, a free end of the inserting strip projects out of the inserting slot.

7. The electrical connector as claimed in claim 6, wherein two opposite turnings of the junction of the base strip and the inserting strip are back-to-bake concaved inward to form a pair of buckling gaps, two opposite ends of the inserting slot face-to-face protrude into the inserting slot to form a pair of buckling blocks spaced from each other and buckled in the corresponding buckling gaps to secure the fastening member to the ear board.

* * * * *